US010233928B2

(12) United States Patent
Furuya et al.

(10) Patent No.: US 10,233,928 B2
(45) Date of Patent: Mar. 19, 2019

(54) TWO-CYLINDER HERMETIC COMPRESSOR

(71) Applicant: Panasonic Intellectual Property Management Co., Ltd., Osaka-shi, Osaka (JP)

(72) Inventors: Shiho Furuya, Kyoto (JP); Hideyuki Horihata, Shiga (JP); Hiraku Shiizaki, Shiga (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 121 days.

(21) Appl. No.: 15/427,919

(22) Filed: Feb. 8, 2017

(65) Prior Publication Data

US 2017/0248138 A1 Aug. 31, 2017

(30) Foreign Application Priority Data

Feb. 26, 2016 (JP) ..... 2016-035038

(51) Int. Cl.
*F04C 23/00* (2006.01)
*F04C 29/00* (2006.01)
(Continued)

(52) U.S. Cl.
CPC ..... *F04C 18/356* (2013.01); *F04C 23/001* (2013.01); *F04C 23/008* (2013.01);
(Continued)

(58) Field of Classification Search
CPC ..... F04C 23/001; F04C 23/008; F04C 18/22; F04C 18/3562; F04C 18/3564;
(Continued)

(56) References Cited

U.S. PATENT DOCUMENTS

2003/0140780 A1* 7/2003 Boyd ..... F04B 39/0094 92/73
2004/0071560 A1* 4/2004 Cho ..... F04C 23/001 417/223

FOREIGN PATENT DOCUMENTS

JP 2001-271773 10/2001
JP 2008-014150 1/2008
(Continued)

OTHER PUBLICATIONS

English Translation of Description for JP2008298037A (Year: 2008).*
(Continued)

*Primary Examiner* — Nathan C Zollinger
(74) *Attorney, Agent, or Firm* — Hamre, Schumann, Mueller & Larson, P.C.

(57) ABSTRACT

A main bearing is disposed on one surface of a first cylinder, an intermediate plate is disposed on another surface of the first cylinder, the intermediate plate is disposed on one surface of a second cylinder, and an auxiliary bearing is disposed on another surface of the second cylinder. A shaft is constituted by a main shaft portion, a first eccentric portion, a second eccentric portion, and an auxiliary shaft portion. A first eccentric portion center position (H1/2) which is the center position of the first eccentric portion in height (H1) is located at a position closer to the main bearing than a first piston center position (P1/2) which is the center position of a first piston in height (P1). A second eccentric portion center position (H2/2) which is the center position of the second eccentric portion in height (H2) is located at a position closer to the auxiliary bearing than a second piston center position (P2/2) which is the center position of a second piston in height (P2).

2 Claims, 5 Drawing Sheets

(51) Int. Cl.
*F04C 27/00* (2006.01)
*F04C 18/356* (2006.01)

(52) U.S. Cl.
CPC ..... *F04C 27/008* (2013.01); *F04C 29/0021* (2013.01); *F04C 29/0057* (2013.01); *F04C 29/0085* (2013.01); *F04C 2240/20* (2013.01); *F04C 2240/30* (2013.01); *F04C 2240/40* (2013.01); *F04C 2240/50* (2013.01); *F04C 2240/60* (2013.01)

(58) Field of Classification Search
CPC ..... F04C 29/0021; F04C 29/0057; F04C 2240/20; F04C 2240/30; F04C 2240/40; F04C 2240/50; F04C 2240/60; F04C 18/356; F04C 29/0085; F04C 27/008
USPC ..... 417/11, 13, 60, 249
See application file for complete search history.

(56) References Cited

FOREIGN PATENT DOCUMENTS

| | | | | | |
|---|---|---|---|---|---|
| JP | 2008-298037 | A | | 12/2008 | |
| JP | 2008298037 | A | * | 12/2008 | |
| JP | 2012-052522 | | | 3/2012 | |
| JP | 2012-167584 | | | 9/2012 | |
| WO | 2011/016452 | A1 | | 2/2011 | |
| WO | WO-2011016452 | A1 | * | 2/2011 | ..... F01C 21/02 |

OTHER PUBLICATIONS

The Extended European Search Report dated Aug. 7, 2017 for the related European Patent Application No. 17153349.0, 9 pages.

* cited by examiner

| | H(mm) | P(mm) | e(mm) | H/P |
|---|---|---|---|---|
| Comparative example 1 | 22.0 | 32.0 | 0.0 | 0.69 |
| Comparative example 2 | 19.2 | 32.0 | 0.0 | 0.60 |
| Comparative example 3 | 17.0 | 32.0 | 0.0 | 0.53 |
| Example 1 | 24.0 | 32.0 | 0.6 | 0.75 |
| Example 2 | 22.0 | 32.0 | 1.6 | 0.69 |
| Example 3 | 19.2 | 32.0 | 3.0 | 0.60 |
| Example 4 | 17.0 | 32.0 | 4.1 | 0.53 |
| Example 5 | 15.0 | 32.0 | 5.1 | 0.47 |
| Example 6 | 13.0 | 32.0 | 6.1 | 0.41 |

TWO-CYLINDER HERMETIC COMPRESSOR

BACKGROUND

1. Technical Field

The present disclosure relates to a two-cylinder hermetic compressor used for an outdoor unit of an air conditioner and a freezer.

2. Description of the Related Art

Generally, a hermetic compressor used for an outdoor unit of an air conditioner and a freezer includes an electric motor unit and a compression mechanism unit in a sealed container. The electric motor unit and the compression mechanism unit are connected to each other by a shaft, and a piston attached to an eccentric portion of the shaft revolves with the rotation of the shaft. A main bearing and an auxiliary bearing are mounted on both end surfaces of a cylinder having the piston provided therein, and the shaft is supported by the main bearing and the auxiliary bearing. Generally, one-cylinder hermetic compressor is often used.

On the other hand, PTL 1 (Unexamined Japanese Patent Publication No. 2001-271773), PTL 2 (Unexamined Japanese Patent Publication No. 2008-14150), PTL 3 (Unexamined Japanese Patent Publication No. 2012-52522), and PTL 4 (Unexamined Japanese Patent Publication No. 2012-167584) disclose a two-cylinder hermetic compressor.

Meanwhile, in comparison to a one-cylinder hermetic compressor that has conventionally been used most often, the two-cylinder hermetic compressor disclosed in PTL 1 to PTL 4 has a shaft provided with two eccentric portions, wherein a sliding loss of the eccentric portions can be reduced by decreasing the outer diameter and the height of the eccentric portions.

However, due to the reduction in the outer diameter and height of the eccentric portions, the sliding areas of the eccentric portions are undesirably decreased, which entails a problem of an increase in maximum stress on the eccentric portions.

SUMMARY

The present disclosure is accomplished in view of the foregoing problem, and aims to provide a two-cylinder hermetic compressor configured such that the center position of an eccentric portion and the center position of a piston differ from each other, thereby being capable of reducing maximum stress on the eccentric portion to suppress an amount of sliding frictional wear on the eccentric portion.

Specifically, in a two-cylinder hermetic compressor according to one example of an exemplary embodiment of the present disclosure, a first eccentric portion center position (H1/2) which is the center position of a first eccentric portion in height (H1) is located at a position closer to a main bearing than a first piston center position (P1/2) which is the center position of a first piston in height (P1). In addition, a second eccentric portion center position (H2/2) which is the center position of a second eccentric portion in height (H2) is located at a position closer to an auxiliary bearing than a second piston center position (P2/2) which is the center position of a second piston in height (P2).

In addition, in the two-cylinder hermetic compressor according to one example of the exemplary embodiment of the present disclosure, a distance (LH) between a first eccentric portion center position (H1/2) that is the center position of a first eccentric portion in height (H1) and a second eccentric portion center position (H2/2) that is the center position of a second eccentric portion in height (H2) is set larger than a distance (LP) between a first piston center position (P1/2) that is the center position of a first piston in height (P1) and a second piston center position (P2/2) that is the center position of a second piston in height (P2).

According to the configuration in which the first eccentric portion center position (H1/2) is located at a position closer to the main bearing than the first piston center position (P1/2) and the second eccentric portion center position (H2/2) is located at a position closer to the auxiliary bearing than the second piston center position (P2/2), or the distance (LH) is set larger than the distance (LP), maximum stress on the first eccentric portion and the second eccentric portion can be reduced, whereby an amount of sliding frictional wear can be suppressed. Thus, the heights of the first eccentric portion and the second eccentric portion can be decreased, whereby a sliding loss can be reduced.

DETAILED DESCRIPTION

Hereinafter, a description will be given of an example of an exemplary embodiment of the present disclosure with reference to the drawings.

Figure 1:
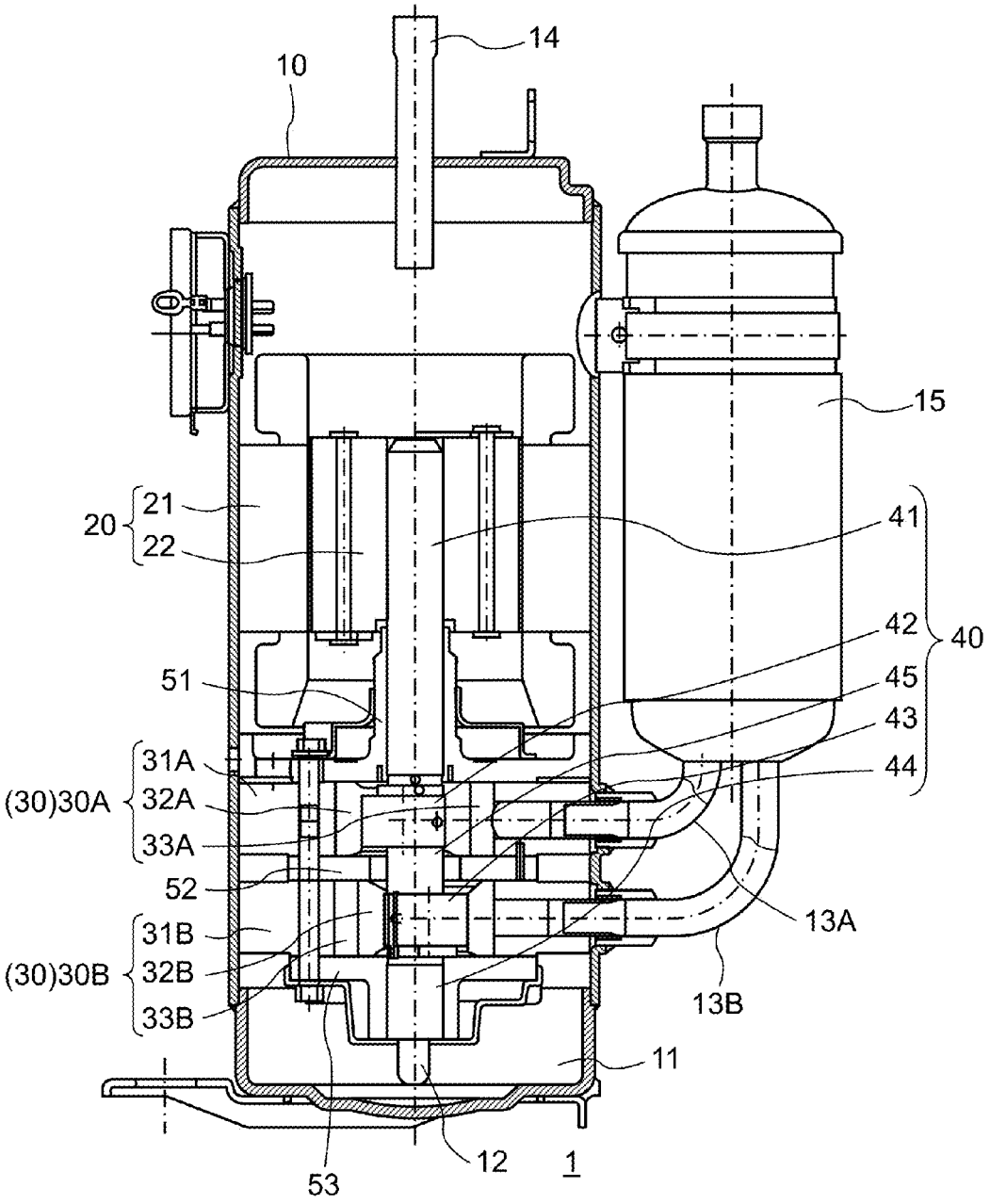
FIG. 1 is a sectional view of a two-cylinder hermetic compressor according to an exemplary embodiment of the present disclosure.

FIG. 1 is a sectional view of a two-cylinder hermetic compressor according to one example of the exemplary embodiment of the present disclosure.

Two-cylinder hermetic compressor 1 according to the present exemplary embodiment includes electric motor unit 20 and compression mechanism unit 30 in sealed container 10. Electric motor unit 20 and compression mechanism unit 30 are connected to each other by shaft 40.

Electric motor unit 20 includes stator 21 fixed on an inner surface of sealed container 10 and rotor 22 rotating in stator 21.

The two-cylinder hermetic compressor according to the present exemplary embodiment includes first compression mechanism unit 30A and second compression mechanism unit 30B as compression mechanism unit 30.

First compression mechanism unit 30A includes first cylinder 31A, first piston 32A disposed in first cylinder 31A, and a vane (not illustrated) that partitions the interior of first cylinder 31A. First compression mechanism unit 30A suctions a low-pressure refrigerant gas and compresses this refrigerant gas due to the revolution of first piston 32A in first cylinder 31A.

Similar to first compression mechanism unit 30A, second compression mechanism unit 30B includes second cylinder 31B, second piston 32B disposed in second cylinder 31B, and a vane (not illustrated) that partitions the interior of second cylinder 31B. Second compression mechanism unit 30B suctions a low-pressure refrigerant gas and compresses this refrigerant gas due to the revolution of second piston 32B in second cylinder 31B.

Main bearing 51 is disposed on one surface of first cylinder 31A, and intermediate plate 52 is disposed on another surface of first cylinder 31A.

In addition, intermediate plate 52 is disposed on one surface of second cylinder 31B, and auxiliary bearing 53 is disposed on another surface of second cylinder 31B.

That is to say, intermediate plate 52 partitions first cylinder 31A and second cylinder 31B. Intermediate plate 52 has an opening larger than the diameter of shaft 40.

Shaft 40 is constituted by main shaft portion 41 which has rotor 22 attached thereto and is supported by main bearing 51, first eccentric portion 42 having first piston 32A attached thereto, second eccentric portion 43 having second piston 32B attached thereto, and auxiliary shaft portion 44 supported by auxiliary bearing 53.

First eccentric portion 42 and second eccentric portion 43 are formed to have a phase difference of 180 degrees, and connection shaft portion 45 is formed between first eccentric portion 42 and second eccentric portion 43.

First compression chamber 33A is formed between main bearing 51 and intermediate plate 52 and between the inner peripheral surface of first cylinder 31A and the outer peripheral surface of first piston 32A. In addition, second compression chamber 33B is formed between intermediate plate 52 and auxiliary bearing 53 and between the inner peripheral surface of second cylinder 31B and the outer peripheral surface of second piston 32B.

The volume of first compression chamber 33A and the volume of second compression chamber 33B are the same. Specifically, the inner diameter of first cylinder 31A and the inner diameter of second cylinder 31B are the same, and the outer diameter of first piston 32A and the outer diameter of second piston 32B are the same. In addition, the height of first cylinder 31A on the inner periphery thereof and the height of second cylinder 31B on the inner periphery thereof are the same, and the height of first piston 32A and the height of second piston 32B are the same.

Oil reservoir 11 is formed at the bottom of sealed container 10, and oil pickup 12 is provided at the lower end of shaft 40.

Although not illustrated, an oil feed path is formed inside shaft 40 in the axial direction, and a communication path for feeding oil to a sliding surface of compression mechanism unit 30 is formed in the oil feed path.

First suction pipe 13A and second suction pipe 13B are connected to the side surface of sealed container 10, and discharge pipe 14 is connected to the top of sealed container 10.

First suction pipe 13A is connected to first compression chamber 33A, and second suction pipe 13B is connected to second compression chamber 33B, respectively. Accumulator 15 is provided at the upstream side of first suction pipe 13A and second suction pipe 13B. Accumulator 15 separates the refrigerant returning from a freezing cycle into a liquid refrigerant and a gas refrigerant. The gas refrigerant flows through first suction pipe 13A and second suction pipe 13B.

Due to the rotation of shaft 40, first piston 32A and second piston 32B revolve in first compression chamber 33A and second compression chamber 33B, respectively.

The gas refrigerant suctioned from first suction pipe 13A and second suction pipe 13B into first compression chamber 33A and second compression chamber 33B is compressed in first compression chamber 33A and second compression chamber 33B due to the revolution of first piston 32A and second piston 32B, and then, discharged into sealed container 10. While the gas refrigerant discharged into sealed container 10 rises through electric motor unit 20, oil is separated therefrom, and then, the resultant gas refrigerant is discharged outside of sealed container 10 from discharge pipe 14.

The oil sucked from oil reservoir 11 due to the rotation of shaft 40 is fed into compression mechanism unit 30 from the communication path to allow the sliding surface of compression mechanism unit 30 to be smooth.

Figure 2:
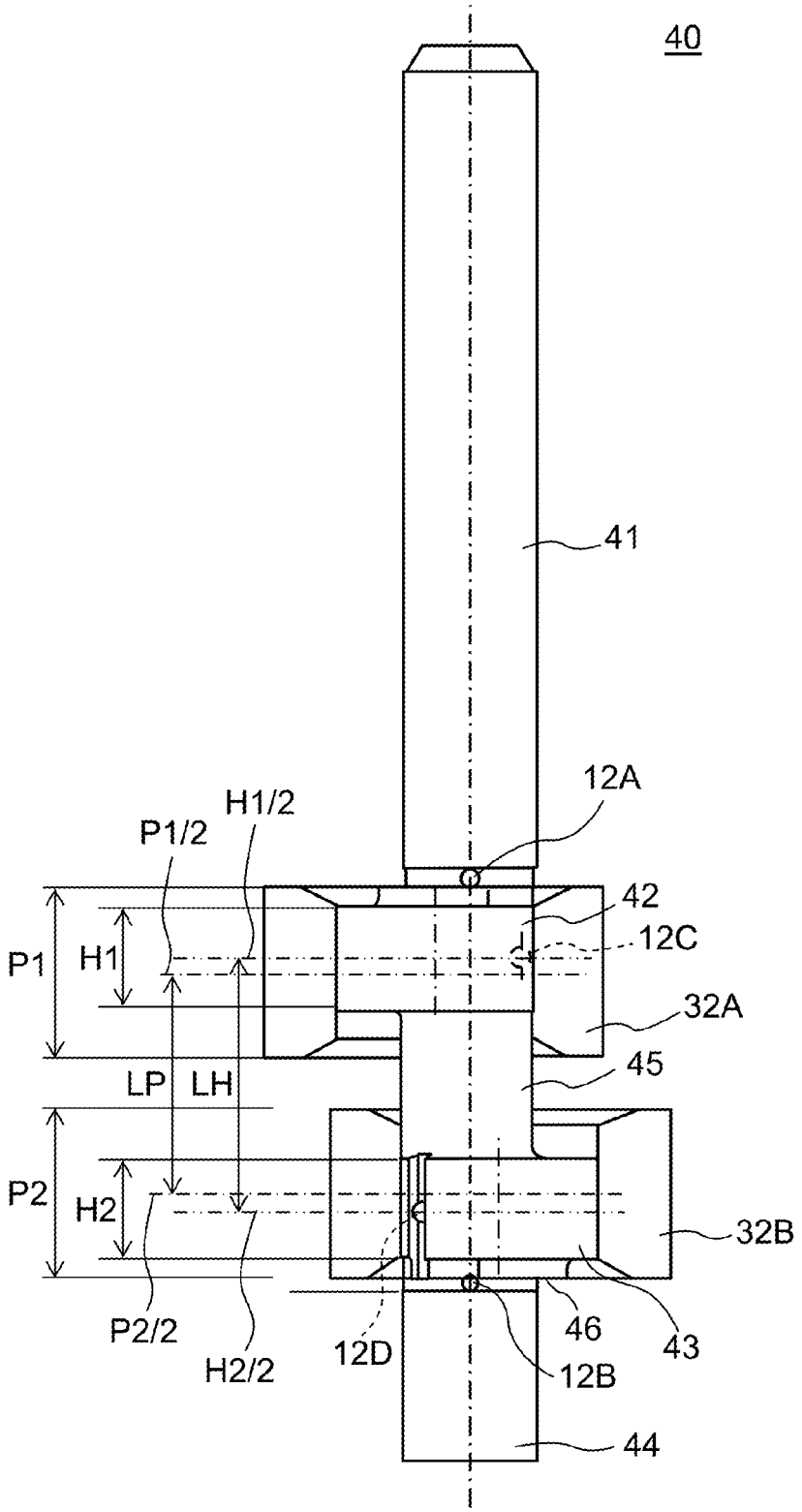
FIG. 2 is a side view of a shaft and pistons used in the two-cylinder hermetic compressor according to the exemplary embodiment of the present disclosure.

FIG. 2 is a side view of the shaft and the pistons used in the two-cylinder hermetic compressor according to one example of the exemplary embodiment of the present disclosure.

Shaft 40 is constituted by main shaft portion 41, first eccentric portion 42, second eccentric portion 43, auxiliary shaft portion 44, and connection shaft portion 45.

First communication path 12A which is in communication with the oil feed path formed inside shaft 40 is open at the end of main shaft portion 41 on the side of first eccentric portion 42, and second communication path 12B which is in communication with the oil feed path formed inside shaft 40 is open at the end of auxiliary shaft portion 44 on the side of second eccentric portion 43.

The diameter is set to be smaller than the diameter of main shaft portion 41 on the position where first communication path 12A is open, and the diameter is set to be smaller than the diameter of auxiliary shaft portion 44 on the position where second communication path 12B is open, whereby oil can be reliably fed to compression mechanism unit 30.

Third communication path 12C which is in communication with the oil feed path formed inside shaft 40 is open at the side surface of first eccentric portion 42, and fourth communication path 12D which is in communication with the oil feed path formed inside shaft 40 is open at the side surface of second eccentric portion 43.

Thrust receiving portion 46 is provided to second eccentric portion 43 on the side of auxiliary shaft portion 44. The diameter of thrust receiving portion 46 is smaller than the diameter of second eccentric portion 43 and larger than the diameter of auxiliary shaft portion 44.

The end face of thrust receiving portion 46 is in contact with the surface of auxiliary bearing 53 on the side of second cylinder 31B illustrated in FIG. 1.

Two-cylinder hermetic compressor 1 according to the present exemplary embodiment receives thrust loads of shaft 40 on the surface of auxiliary bearing 53 on the side of second cylinder 31B through the end face of thrust receiving portion 46, thereby being capable of stably receiving thrust loads as compared to the configuration of receiving thrust loads on auxiliary shaft portion 44.

In two-cylinder hermetic compressor 1 according to the present exemplary embodiment, first eccentric portion center position (H1/2) which is the center position of first eccentric portion 42 in height (H1) is located at a position closer to main bearing 51 than first piston center position (P1/2) which is the center position of first piston 32A in height (P1). In addition, in two-cylinder hermetic compressor 1 according to the present exemplary embodiment, second eccentric portion center position (H2/2) which is the center position of second eccentric portion 43 in height (H2) is located at a position closer to auxiliary bearing 53 than second piston center position (P2/2) which is the center position of second piston 32B in height (P2).

In addition, in two-cylinder hermetic compressor 1 according to the present exemplary embodiment, distance (LH) between first eccentric portion center position (H1/2) that is the center position of first eccentric portion 42 in height (H1) and second eccentric portion center position (H2/2) that is the center position of second eccentric portion 43 in height (H2) is set larger than distance (LP) between first piston center position (P1/2) that is the center position of first piston 32A in height (P1) and second piston center position (P2/2) that is the center position of second piston 32B in height (P2).

According to the configuration in which first eccentric portion center position (H1/2) is located at a position closer to main bearing 51 than first piston center position (P1/2) and second eccentric portion center position (H2/2) is located at a position closer to auxiliary bearing 53 than second piston center position (P2/2), or distance (LH) is set larger than distance (LP), maximum stress on first eccentric portion 42 and second eccentric portion 43 can be reduced, whereby an amount of sliding frictional wear can be suppressed. Thus, heights (H1 and H2) of first eccentric portion 42 and second eccentric portion 43 can be decreased, whereby a sliding loss can be reduced.

The ratio of height (H1) of first eccentric portion 42 to height (P1) of first piston 32A can be set to be 40% to 75%, and the ratio of height (H2) of second eccentric portion 43 to height (P2) of second piston 32B can be set to be 40% to 75%.

Figure 3:
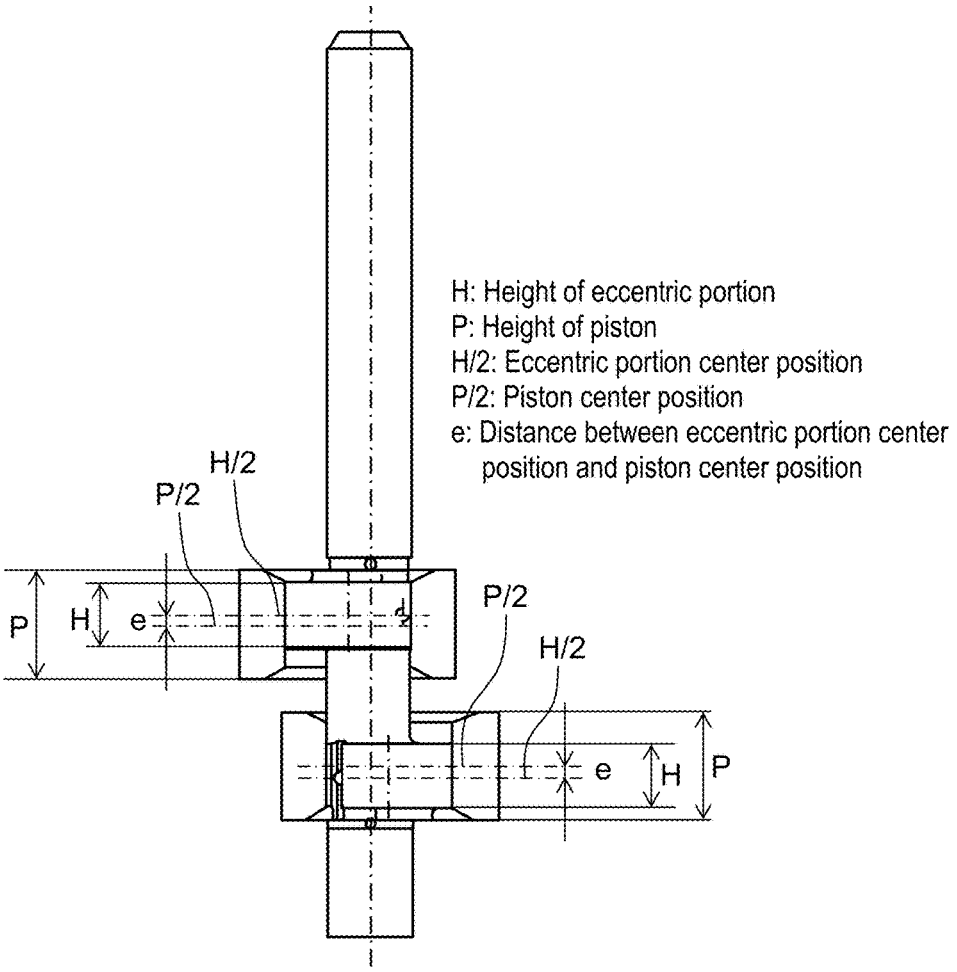
FIG. 3 is a view illustrating specifications of Examples and Comparative Examples used for the test of maximum stress values on an auxiliary shaft portion in the two-cylinder hermetic compressor according to the exemplary embodiment of the present disclosure.

FIGS. 3 and 4 illustrate test results of maximum stress values on the auxiliary shaft portion in the two-cylinder hermetic compressor according to the exemplary embodiment of the present disclosure.

FIG. 3 shows the specification of Comparative Examples in which eccentric portion center position (H/2) and piston center position (P/2) are aligned with each other, and Examples in which there is a distance between eccentric portion center position (H/2) and piston center position (P/2).

In Example 1, height (H) of an eccentric portion is set to be 24.0 mm, height (P) of a piston is set to be 32.0 mm, distance (e) between eccentric portion center position (H/2) and piston center position (P/2) is set to be 0.6 mm, and ratio (H/P) of height (H) of the eccentric portion to height (P) of the piston is set to be 75%.

In Example 2, height (H) of an eccentric portion is set to be 22.0 mm, height (P) of a piston is set to be 32.0 mm, distance (e) between eccentric portion center position (H/2) and piston center position (P/2) is set to be 1.6 mm, and ratio (H/P) of height (H) of the eccentric portion to height (P) of the piston is set to be 69%.

In Example 3, height (H) of an eccentric portion is set to be 19.2 mm, height (P) of a piston is set to be 32.0 mm, distance (e) between eccentric portion center position (H/2) and piston center position (P/2) is set to be 3.0 mm, and ratio (H/P) of height (H) of the eccentric portion to height (P) of the piston is set to be 60%.

In Example 4, height (H) of an eccentric portion is set to be 17.0 mm, height (P) of a piston is set to be 32.0 mm, distance (e) between eccentric portion center position (H/2) and piston center position (P/2) is set to be 4.1 mm, and ratio (H/P) of height (H) of the eccentric portion to height (P) of the piston is set to be 53%.

In Example 5, height (H) of an eccentric portion is set to be 15.0 mm, height (P) of a piston is set to be 32.0 mm, distance (e) between eccentric portion center position (H/2) and piston center position (P/2) is set to be 5.1 mm, and ratio (H/P) of height (H) of the eccentric portion to height (P) of the piston is set to be 47%.

In Example 6, height (H) of an eccentric portion is set to be 13.0 mm, height (P) of a piston is set to be 32.0 mm, distance (e) between eccentric portion center position (H/2) and piston center position (P/2) is set to be 6.1 mm, and ratio (H/P) of height (H) of the eccentric portion to height (P) of the piston is set to be 41%.

Figure 4A:
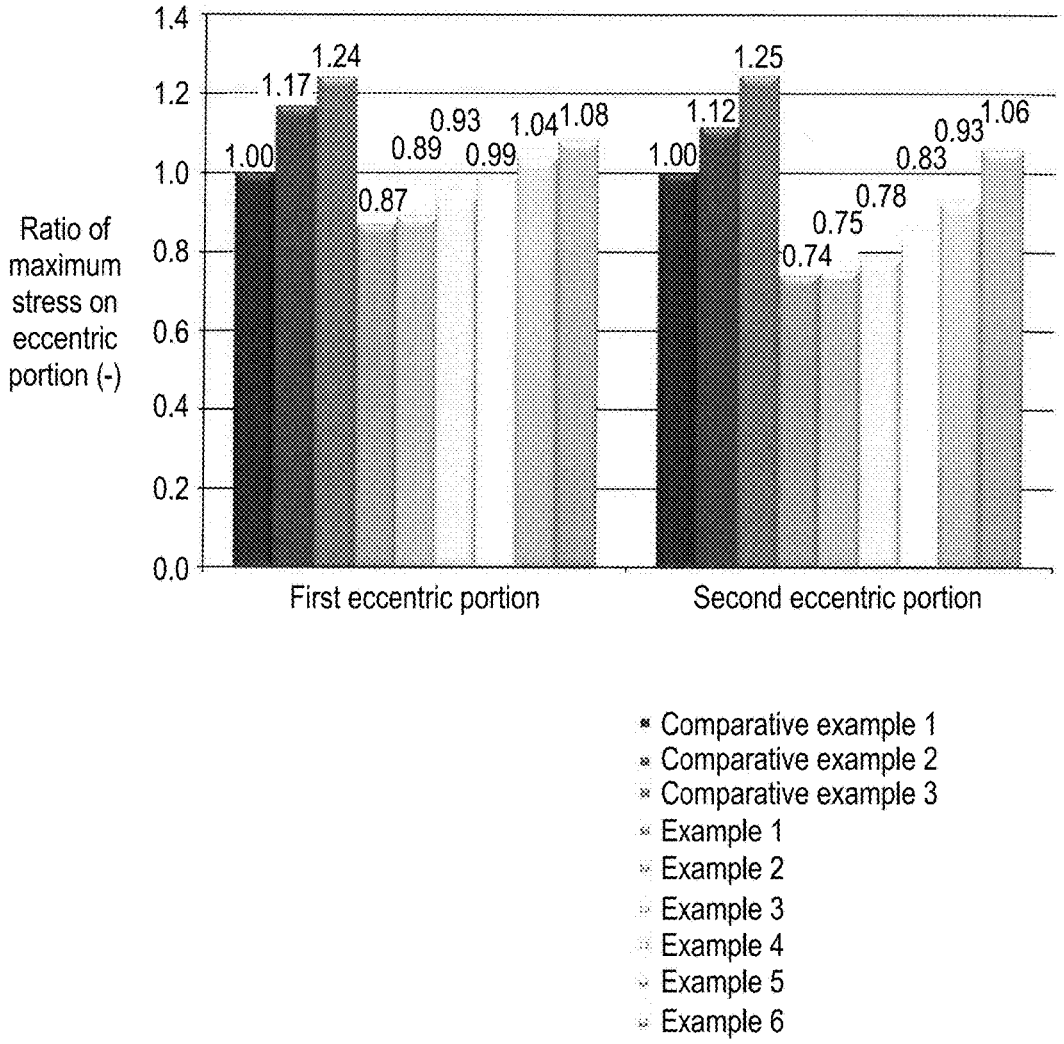
FIG. 4A is a graph showing the test result of maximum stress values on eccentric portions in Examples and Comparative Examples shown in FIG. 3.

FIG. 4A is a graph showing the test result of maximum stress values on the first eccentric portion and the second eccentric portion in Comparative Examples and Examples.

As shown in Comparative Examples 1 to 3 in FIG. 4A, when height (H) of eccentric portion is decreased with height (P) of piston being fixed, a maximum stress value is increased on eccentric portions 42 and 43.

In Example 1, height (P) of the piston is the same as that in Comparative Example 1, height (H) of the eccentric portion is larger than that in Comparative Example 1 by 2.0 mm, and distance (e) between eccentric portion center position (H/2) and piston center position (P/2) is set to be 0.6 mm. The maximum stress value on first eccentric portion 42 in Example 1 is lower than that in Comparative Example 1 by 13%, and the maximum stress value on second eccentric portion 43 in Example 1 is lower than that in Comparative Example 1 by 26%.

In Example 2, height (P) of the piston and height (H) of the eccentric portion are the same as those in Comparative Example 1, and distance (e) between eccentric portion center position (H/2) and piston center position (P/2) is set to be 1.6 mm. The maximum stress value on first eccentric portion 42 in Example 2 is lower than that in Comparative Example 1 by 11%, and the maximum stress value on second eccentric portion 43 in Example 2 is lower than that in Comparative Example 1 by 25%.

In Example 3, height (P) of the piston and height (H) of the eccentric portion are the same as those in Comparative Example 2, and distance (e) between eccentric portion center position (H/2) and piston center position (P/2) is set to be 3.0 mm. As compared to Comparative Example 1, the maximum stress value on first eccentric portion 42 in Example 3 is lower by 7%, while the maximum stress value on first eccentric portion 42 in Comparative Example 2 is higher by 17%, and the maximum stress value on second eccentric portion 43 in Example 3 is lower by 22%, while the maximum stress value on second eccentric portion 43 in Comparative Example 2 is higher by 12%.

In Example 4, height (P) of the piston and height (H) of the eccentric portion are the same as those in Comparative Example 3, and distance (e) between eccentric portion center position (H/2) and piston center position (P/2) is set to be 4.1 mm. As compared to Comparative Example 1, the maximum stress value on first eccentric portion 42 in Example 4 is lower by 1%, while the maximum stress value on first eccentric portion 42 in Comparative Example 3 is higher by 24%, and the maximum stress value on second eccentric portion 43 in Example 4 is lower by 17%, while the maximum stress value on second eccentric portion 43 in Comparative Example 3 is higher by 25%.

In Example 5, height (H) of the eccentric portion is further decreased and distance (e) between eccentric portion center position (H/2) and piston center position (P/2) is further increased, with respect to Example 4, and in Example 6, height (H) of the eccentric portion is further decreased and distance (e) between eccentric portion center position (H/2) and piston center position (P/2) is further increased, with respect to Example 5.

The maximum stress value in Example 6 is increased with respect to Example 4, and the maximum stress value in Example 6 is increased with respect to Example 5. However, the maximum stress values in Examples 5 and 6 are lower than those in Comparative Example 3 in which the height of the eccentric portion is larger.

Figure 4B:
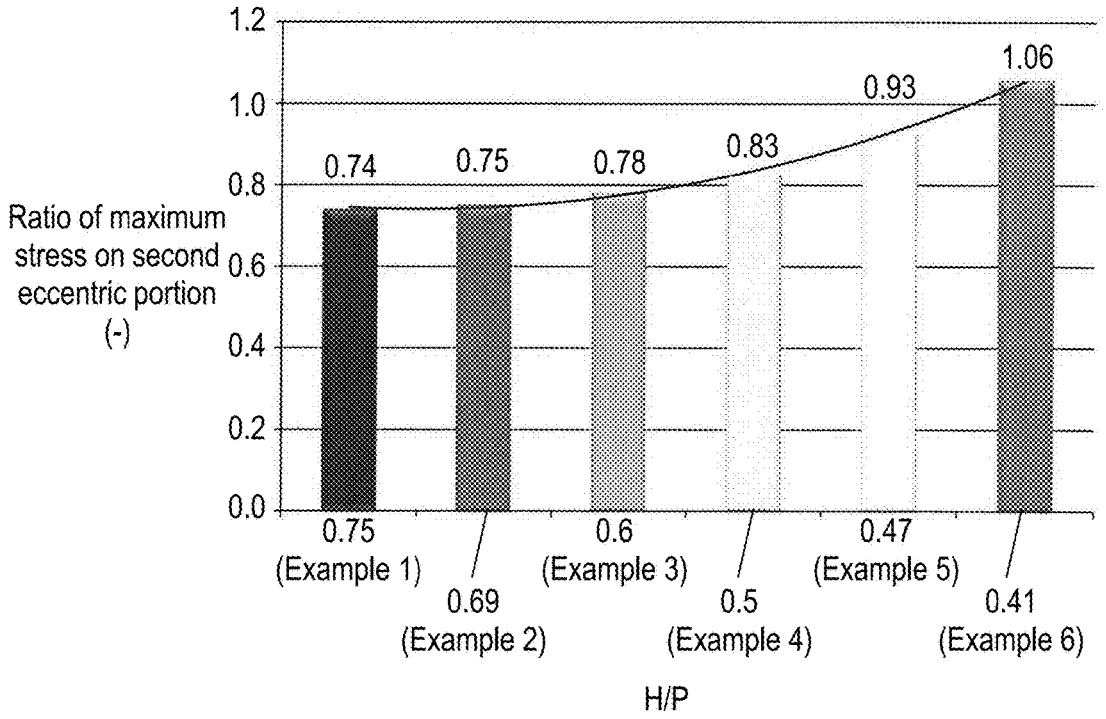
FIG. 4B is a graph showing the test result of maximum stress values on second eccentric portions in Examples shown in FIG. 3.

FIG. 4B shows the ratio of maximum stress on second eccentric portion in Examples 1 to 6 in FIG. 4A.

FIG. 4B shows that the maximum stress on second eccentric portion 43 is not significantly increased when H/P that is the ratio of eccentric portion height (H) to piston height (P) ranges from 0.40 to 0.75. Specifically, FIG. 4B shows that satisfactory effect can be provided within the range of 40% to 75% of the ratio of eccentric portion height (H) to piston height (P) with respect to Comparative Examples in which eccentric portion center position (H/2) and piston center position (P/2) are aligned with each other.

As described above, the present disclosure provides a two-cylinder hermetic compressor configured such that the center position of an eccentric portion and the center position of a piston differ from each other, thereby being capable of reducing maximum stress on the eccentric portion to suppress an amount of sliding frictional wear on the eccentric portion. Accordingly, the present disclosure is applicable not only to a two-cylinder hermetic compressor but also to a multi-stage compressor provided with a plurality of, such as three or more, cylinders.

What is claimed is:

1. A two-cylinder hermetic compressor comprising:

an electric motor unit and a compression mechanism unit in a sealed container, wherein the electric motor unit and the compression mechanism unit are connected to each other by a shaft, the electric motor unit includes a stator fixed on an inner surface of the sealed container and a rotor that rotates in the stator, a first compression mechanism unit and a second compression mechanism unit are provided as the compression mechanism unit, the first compression mechanism unit includes a first cylinder and a first piston provided in the first cylinder, the second compression mechanism unit includes a second cylinder and a second piston provided in the second cylinder, a main bearing is disposed on one surface of the first cylinder and an intermediate plate is disposed on another surface of the first cylinder, the intermediate plate is disposed on one surface of the second cylinder and an auxiliary bearing is disposed on another surface of the second cylinder, the shaft includes a main shaft portion to which the rotor is attached and which is supported by the main bearing, a first eccentric portion to which the first piston is mounted, a second eccentric portion to which the second piston is mounted, and an auxiliary shaft portion supported by the auxiliary bearing, a first eccentric portion center position (H1/2) that is a center position of the first eccentric portion in height (H1) is located at a position closer to the main bearing than a first piston center position (P1/2) that is a center position of the first piston in height (P1), a second eccentric portion center position (H2/2) that is a center position of the second eccentric portion in height (H2) is located at a position closer to the auxiliary bearing than a second piston center position (P2/2) that is a center position of the second piston in height (P2), and a distance (LH) between the first eccentric portion center position (H1/2) that is the center position of the first eccentric portion in height (H1) and the second eccentric portion center position (H2/2) that is the center position of the second eccentric portion in height (H2) is set larger than a distance (LP) between the first piston center position (P1/2) that is the center position of the first piston in height (P1) and the second piston center position (P2/2) that is the center position of the second piston in height (P2).

2. The two-cylinder hermetic compressor according to claim 1, wherein a ratio of the height (H1) of the first eccentric portion to the height (P1) of the first piston is set to be 40% to 75%, and a ratio of the height (H2) of the second eccentric portion to the height (P2) of the second piston is set to be 40% to 75%.

* * * * *